US007921756B2

(12) United States Patent
Vegliante et al.

(10) Patent No.: US 7,921,756 B2
(45) **Date of Patent: *Apr. 12, 2011**

(54) FILM CUTTER ASSEMBLY

(75) Inventors: Paul Vegliante, Franklin Lakes, NJ (US); Sean Neiberger, Los Angeles, CA (US); Rudolf Pavlik, Lincolnshire, IL (US); Ian Kaiser, La Canada, CA (US)

(73) Assignee: AEP Industries, Inc., South Hackensack, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/741,521

(22) Filed: Dec. 20, 2000

(65) Prior Publication Data

US 2002/0023526 A1 Feb. 28, 2002

(51) Int. Cl.
*B26D 5/10* (2006.01)

(52) U.S. Cl. ..... 83/614; 83/374

(58) Field of Classification Search ..... 83/374, 83/175, 471.3, 56, 614, 455, 613, 91; 225/91
See application file for complete search history.

(56) References Cited

U.S. PATENT DOCUMENTS

| | | | | |
|---|---|---|---|---|
| 2,420,460 A | | 5/1947 | Bowdoin et al. | |
| 3,277,760 A | | 10/1966 | Keene et al. | |
| 3,549,066 A | * | 12/1970 | Wankow | 225/25 |
| 3,779,121 A | * | 12/1973 | Lagain | 83/614 |
| 3,821,915 A | * | 7/1974 | Larrable | 83/174 |
| 4,196,647 A | * | 4/1980 | Fish | 83/175 |
| 4,197,774 A | * | 4/1980 | Singh et al. | 83/374 |
| 4,210,043 A | * | 7/1980 | Urion et al. | 83/175 |

(Continued)

FOREIGN PATENT DOCUMENTS

JP 58217576 A * 12/1983

OTHER PUBLICATIONS

"Phthalate Ester Plasticizers—Why and How They Are Used". P. R. Graham, Environmental Health Perspectives, vol. 3, (Jan. 1973), pp. 8, Published by: The National Institute of Environmental Health Sciences (NIEHS).*

*Primary Examiner* — Kenneth E. Peterson
*Assistant Examiner* — Sean Michalski
(74) *Attorney, Agent, or Firm* — Porzio, Bromberg & Newman, P.C.

(57) ABSTRACT

The present invention relates to a film cutter assembly in which a blade housing slides along a pair of rails. The blade housing is formed of an upper portion for housing the blade. Either end of the upper portion has a rounded inclined shape from a bottom edge to form a sled shaped runner. The sled shaped runner extends beyond the blade such that the user is prevented from touching the blade. A lower portion of the blade housing slidables bilaterally in a cavity formed below the rails. A clearance is formed between the blade and the rails to allow the blade housing to easily slide over a film to be cut even if the film bunched or doubled over. The upper portion of the blade housing has a concave shape for allowing a user's fingers to easily grip the blade housing. Preferably, the rails are formed of a material which provides an attractive charge to attract the film to the rail and help hold the film flat before and after cutting. For example, the rails can be formed of flexible vinyl or acetal.

13 Claims, 5 Drawing Sheets

U.S. PATENT DOCUMENTS 4,787,284 A 11/1988 Chen
4,856,975 A * 8/1989 Gearhart ..... 425/131.1
4,957,023 A 9/1990 Chen
4,960,022 A * 10/1990 Chuang ..... 83/175
5,022,154 A * 6/1991 Johnson ..... 30/34.2
5,036,740 A * 8/1991 Tsai ..... 83/455
5,103,710 A 4/1992 Ross
5,243,890 A * 9/1993 Ober ..... 83/471.2
5,292,046 A * 3/1994 Kaiser et al. ..... 225/19
5,398,576 A 3/1995 Chiu
5,421,231 A * 6/1995 Break et al. ..... 83/471.3
5,440,961 A 8/1995 Lucas, Jr. et al.
5,524,515 A * 6/1996 Boda ..... 83/455
5,611,255 A 3/1997 Evans
5,758,559 A * 6/1998 Capitao et al. ..... 83/614
5,768,968 A 6/1998 Park et al.
5,772,094 A * 6/1998 Kaiser et al. ..... 225/39
5,819,618 A * 10/1998 Rodriguez ..... 83/455
6,223,639 B1 5/2001 Chen

* cited by examiner

FILM CUTTER ASSEMBLY

BACKGROUND OF THE INVENTION

1. Field of the Invention

The present invention relates to a film cutter method and apparatus in which a cutting blade extends from the interior of a housing, the housing having a sled shaped runner and an adjustable clearance to an upper surface of a rail in which the housing is slidably moved, thereby effectively and expeditiously cutting film, such as food service wrap, even if the film is bunched or doubled over without injury to a user of the apparatus.

2. Related Art

The present invention relates to an improved film cutter for plastic wrap. Conventional plastic wrap has many uses for covering foods before putting them in a refrigerator, microwave or other storage means. Typically, conventional thin plastic wrap is rolled on a rod and dispensed by pulling outward a section thereof for use, the extended plastic wrap is then cut off by a blade or zig-zag cutting device attached along the edge of a box in which the roll of wrap is housed. The problem with these devices is that the thin plastic wrap is easily distorted by sticking to itself due to static electricity. Also, a user can cut themselves on the exposed blade.

U.S. Pat. No. 4,957,023 describes a wrap dispenser with an automatic cutting device. A cutting device is fixed on a mount and is able to be slidably moved along a fixed track by way of a transmission mechanism powered by a motor that is in turn actuated by a number of batteries. This patent has the drawback of being cumbersome and expensive to manufacture.

Other conventional attempts have included cutting apparatus having a plurality of guide wheels to travel in a channel beneath a cutting surface. U.S. Pat. No. 5,440,961 describes a film cutting apparatus in which a plurality of guide wheels are supported in a channel for guiding a cutting device during travel. A rotatable cutting wheel is disposed within a semicircular housing. A top surface of a cutting plane is formed of a urethane tape to adhere the film to the surface during cutting. The above-described film cutter has the limitation that the guide wheels and rotating cutting wheel use complex mechanical interaction resulting in high manufacturing costs. This cutter also has the drawback that the urethane tape loses the ability with use to immobilize the film because of loss of the adhesiveness of the tape.

U.S. Pat. No. 4,197,774 describes a travelling cutter assembly in which an elongated track has a slot for slidably receiving and returning a cutter slide therein. The track has roughened upper surface elements. A cutting element includes a housing having a smooth lower surface that extends laterally for locally immobilizing the sheet by pressing it against the roughened track surface. The use of a roughened surface for immobilizing a material has the shortening that the film can only be immobilized against the surface upon application of pressure between the cutting device and the surface.

U.S. Pat. No. 5,398,576 describes a cutting device having a positioning unit formed of two elongated vertical side walls interconnected to a horizontal top wall to define a sliding space between the vertical side walls and under the top wall. A cutter includes a sliding body with two vertical plates and two horizontal plates extending from the vertical plates under the horizontal top wall. A blade is mounted in a notch of the cutter. The blade extends rearwardly and downwardly from the front end surface. This patent has the disadvantage of exposure of the blade to a user and difficulty of the blade cutter bunched or misaligned film.

It is desirable to provide an improved film cutter apparatus overcoming the above-described deficiencies in which the apparatus can be used to conveniently and effectively cut film even if the film is bunched or doubled over while providing safety to the user.

SUMMARY OF THE INVENTION

The present invention relates to a film cutter assembly in which a blade housing slides along a pair of rails. The blade housing is formed of an upper portion for housing the blade. Either end of the upper portion has a rounded inclined shape from a bottom edge to form a sled shaped runner. The sled shaped runner extends beyond the blade such that the user is prevented from touching the blade. A lower portion of the blade housing slides bilaterally in a cavity formed below the rails. A clearance is formed between the blade and the rails to allow the blade housing to easily slide over a film to be cut even if the film bunched or doubled over.

The upper portion of the blade housing has a concave shape for allowing a user's fingers to easily grip the blade housing. Preferably, the rails are formed of a material which provides an attractive charge to attract the film to the rail and help hold the film flat before and after cutting. For example, the rails can be formed of flexible vinyl or acetal.

The rails can be attached or integral with an elongated rail base. An end cap can be releasably attached to either end of the elongated rail base to provide a bumper and release upon excessive pressure applied to the blade housing. A u-shaped guide formed in the elongated rail base can receive an edge of a carton for clamping the apparatus to the carton. A depression in the rear surface of the elongated rail base is adapted to receive a cover of the carton.

The invention will be more fully described by reference to the following drawings.

DETAILED DESCRIPTION

Figure 1:
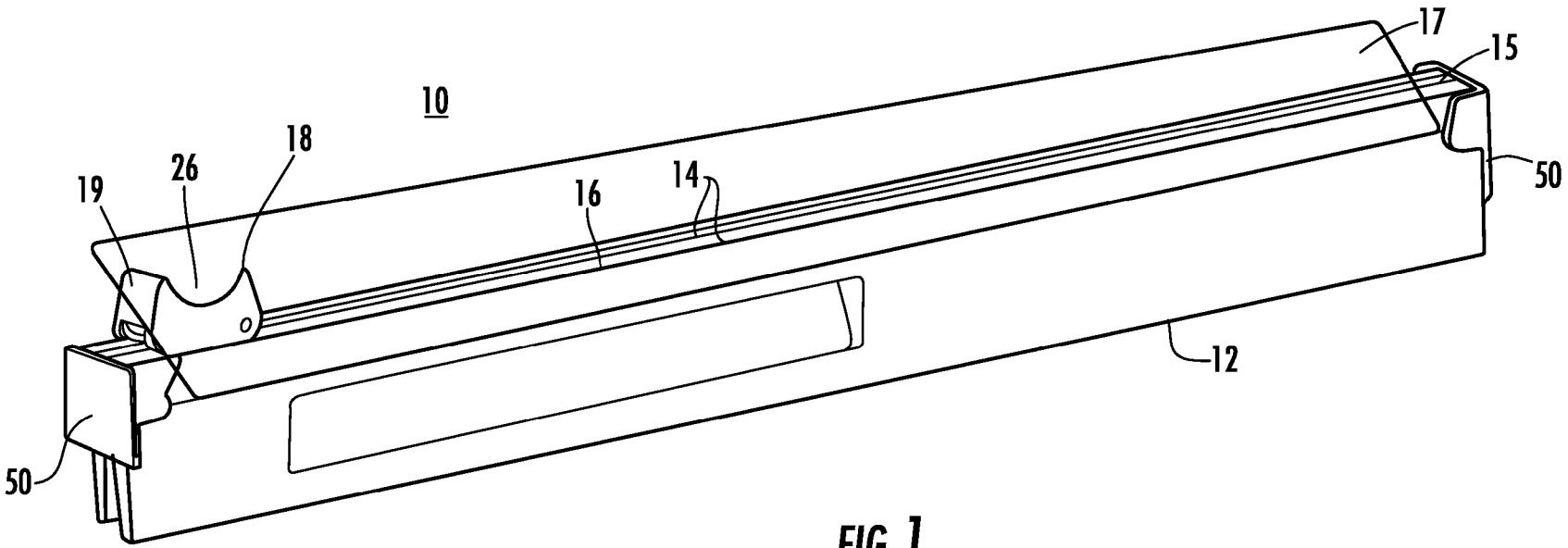
FIG. 1 is a front and side elevational view of a film cutter assembly in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
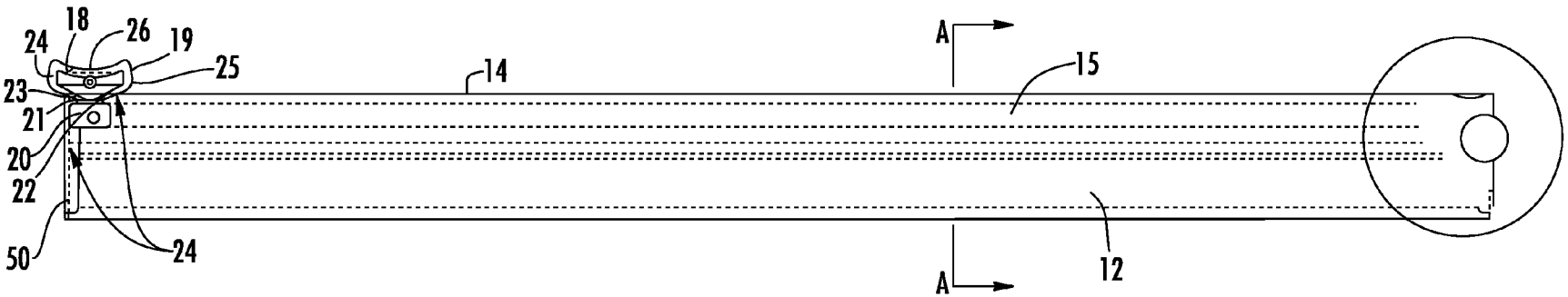
FIG. 2 is a side sectional view of the film cutter assembly in accordance with the teachings of the present invention.
Figure 4:
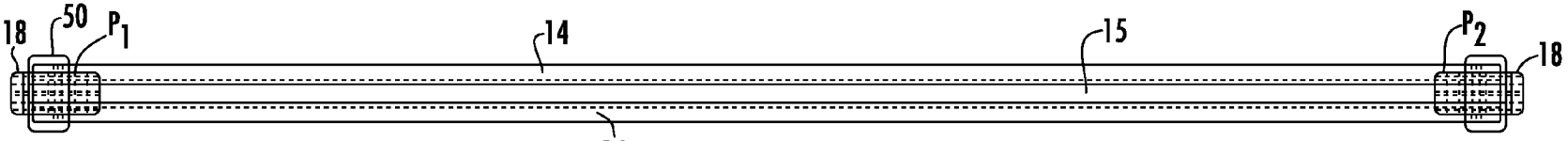
FIG. 4 is a top plan view of the film cutter assembly shown in FIG. 1.

FIGS. 1 and 2 illustrate film cutter assembly 10 in accordance with the teachings of the present invention. Elongated rail base 12 is coupled to a pair of rails 14 along top surface 16. Alternately, rails 14 are integral with elongated rail base 12. Cavity 15 is formed below rails 14 and extends between rails 14. Plastic film 17 is dispensed from a roll (not shown) and is pulled across rails 14. Elongated rail base 12 can have a length corresponding to the width of any size film. For, example, for a 12, 18 or 24 inches wide film elongated rail base 12 respectively has a length of about 13.2, about 19.2 or about 25.2 inches.

Preferably, elongated rail base 12 is formed of a first material having durability properties. For example, elongated rail base 12 can be formed of rigid vinyl such as 87549 manufactured by Geon or polyvinyl chloride (PVC). Preferably, rails 14 are formed of a second material which provides an attractive charge to attract film 17 to rails 14 and to help hold film 17 flat before and after cutting. Suitable materials that can be used to provide an attractive force, such as a static charge, include a material having a shore A, durometer 75 or other flexible vinyl materials such as vinyl manufactured be Teknor as Apex 3300-75 NT, acrylic or PVC. Co-extrusion can be used to form elongated rail base 12 and rails 14 from two different materials.

Blade housing 18 is formed of upper portion 19 and lower portion 20. Middle portion 21 connects upper portion 19 to lower portion 20. Upper portion 19 of blade housing 18 houses blade 22. Lower portion 20 of blade housing 18 is received in channel 15 of elongated rail base 12.

Figure 3:
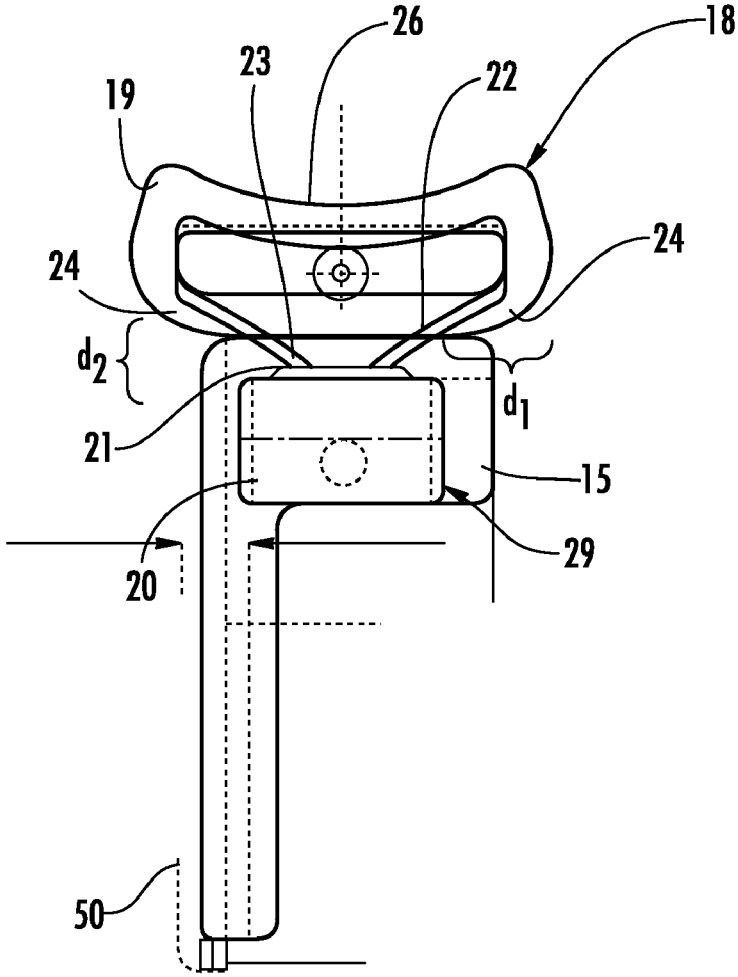
FIG. 3 is a side sectional view of a blade housing showing movement of the blade housing between end positions of an elongated rail base.

Bottom surface 23 of upper portion 19 includes bottom edge 24 which protrudes from blade 22 and prevents a user from contacting blade 22. Blade 22 protrudes from bottom surface 23 at a distance d1 behind end surface 25, as shown in FIG. 3. End surface 25 is upwardly inclined and rounded from bottom edge 24. End surface 25 and bottom edge 24 form a sled shaped runner to allow upper portion of blade housing 18 to slide back and forth along rails 14 between position p1 and position p2 and act in conjunction with rails 14 to keep film 17 from "bunching up" and allow film 17 to remain flat during sliding of blade housing 18 along rails 14.

Preferably, blade housing 18 is formed of a flexible material having good lubricity for sliding along top surface 16 of rails 14 and within cavity 15. For example suitable materials for blade housing 18 are acetal, such as RTP 801 manufactured by DEL or silicon.

Upper portion 19 of blade housing 18 includes grip surface 26. Preferably, grip surface 26 is contacted by a finger of the user for moving blade housing 18. Grip surface 26 has a concave shape for allowing a user's finger to easily grip blade housing 18 and maintains a user's point of contact centrally on the top of the blade housing 18, thereby preventing rocking or teetering of blade housing 18.

Figure 5:
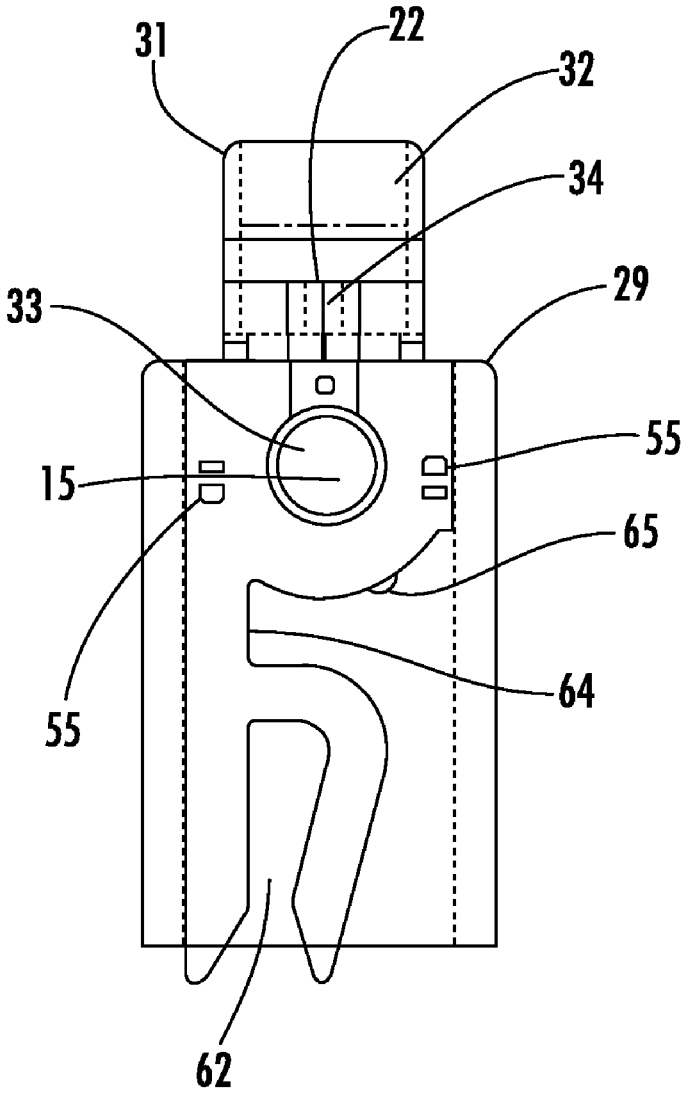
FIG. 5 is an end view of the film cutter assembly viewed from an end having the end cap removed.

Lower portion 20 of blade housing 18 forms a tracking device 29, as shown in FIG. 3. Tracking device 29 is received in cavity 15 for bilaterally sliding along cavity 15. Preferably, tracking device 19 has a tubular shape which slides in cavity 15 having a corresponding tubular shape, as shown in FIG. 5. Middle portion 21 is selected to determine the distance d2 between tracking device 29 and blade 22. Distance d2 is selected to provide a predetermined clearance between blade 22 and rails 14 to allow blade housing 18 to be used with bunched or doubled over film.

Figure 6:
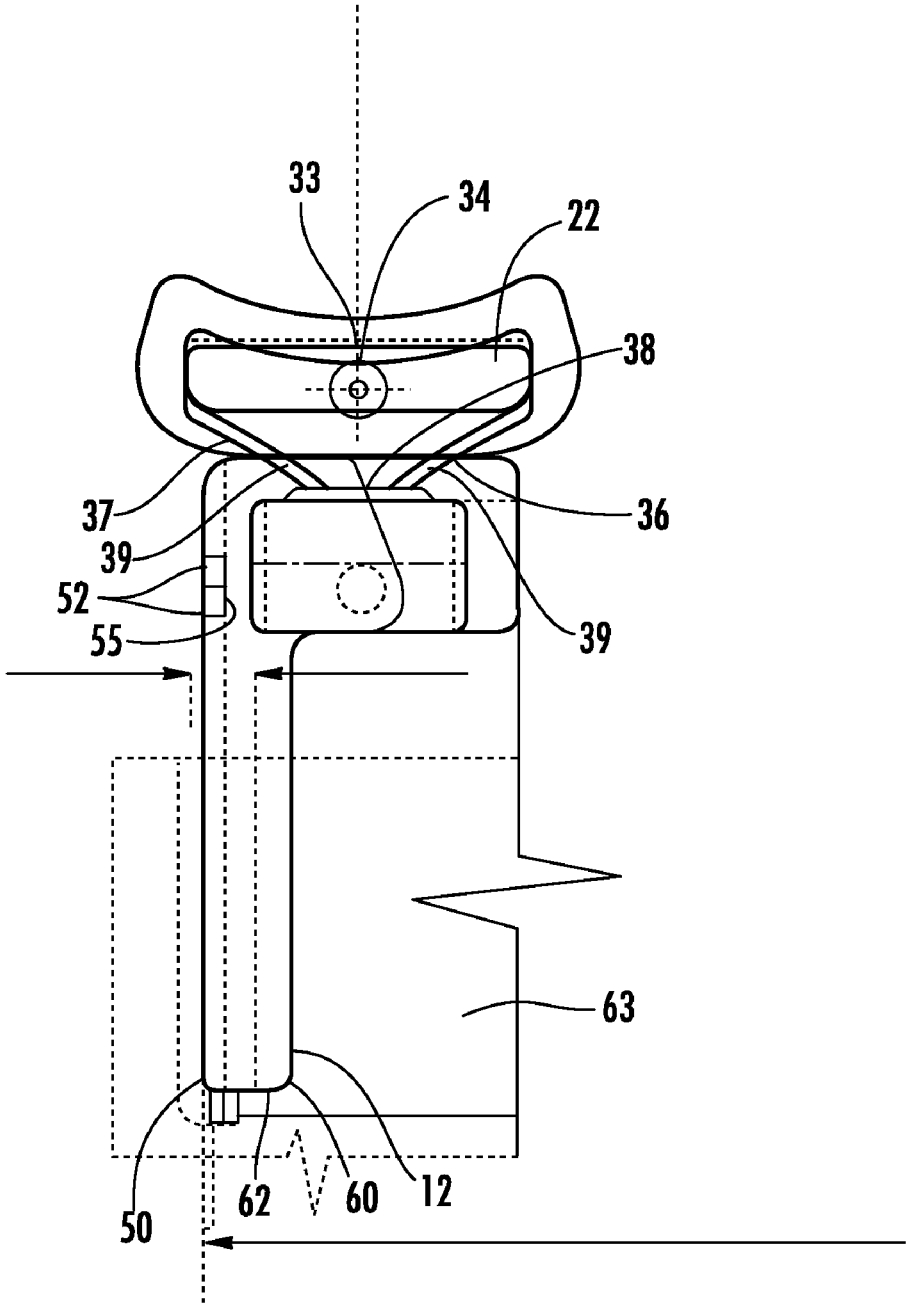
FIG. 6 is a side sectional view of the blade housing attached to a film carton.

Blade housing 18 can be formed of a two piece construction having a left section 31 and a right section 32, as shown in FIG. 6. Blade 22 is positioned between left section 31 and right section 32. Blade 22 is attached to left section 31 and right section 32 with rivet 33 extending through aperture 34 of blade 22. Rivet 33 secures blade 22 to a core of blade housing 18 for ensuring safety.

Blade 22 can have angled side edges 36, 37. For example, side edges 36, 37 can be angled at a 30° angle from bottom surface 38 of blade 22. Cutting portion 39 extending from blade housing 20 is used to cut plastic film 17. The blade angle provides optimal performance of cutting and reduces exposure of blade 22 to the user to allow blade 22 to cut plastic film 17 and not a user's fingers. For example the preferred blade angle optimizes cutting of PVC and polyethylene film. Alternatively, blade 22 can have a rounded shape with a portion of the rounded shape forming the cutting portion. A suitable material for blade 22 is stainless steel.

End cap 50 is formed of a pair of male protrusions 52, which are integral with edge 55, as shown in FIG. 1 and FIG. 5. Male protrusions 52 snap onto female receptacles 55 positioned at both ends of elongated rail base 12. End cap 50 acts as a bumper and releases from elongated rail base 12 if too much pressure is exerted against blade housing 18 at either end of elongated rail base 12. Accordingly, blade housing 18 will remain intact and be removed from elongated rail base 12 if excessive force is applied to blade housing 18. A suitable material for end cap 50 is an acetal such as 2558-112 manufactured by Makrabon or polycarbonate. Alternative methods can be used including a rivet, plug, glue, pinching, piercing or other applications known in the art to prevent blade housing 18 from escaping elongated rail base 12.

Rear edge 60 of elongated base rail 12 includes extension 62 forming a "u" shape, as shown in FIGS. 5 and 6. A side edge of a carton 63 is received in the "u" shape. Depression 64 is formed in rear edge 60 between extension 62 and outer surface 65 of channel 15. Depression 64 is adapted to receive a lid of the carton (not shown) and prevent movement thereof.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

We claim:

1. A film cutter apparatus for cutting plastic wrap comprising:

an elongated rail base;

a pair of rails formed at a top surface of said elongated rail base and a channel formed within said rail base and between said rails;

and a blade housing formed of an upper portion and a lower portion;

said upper portion of said blade housing houses a blade but no wheels, a bottom edge of said upper portion of said blade housing protruding on either end from said blade and an end surface being rounded and inclined upwardly and from either end of said bottom edge, said blade is non-rotatable supported in said housing and is angled from said bottom edge of said upper portion and depends from the upper portion to the lower portion and can cut in both directions;

said lower portion of said blade housing slidably moving in said channel, wherein said pair of rails are formed of a first material comprising polyvinyl chloride comprising at least 10% plasticizer which provides an attraction to said plastic wrap received over said rails for attracting said plastic wrap received over said rails for clinging said plastic wrap to said rails before, during and after cutting of said plastic wrap by sliding said blade housing within said channel, wherein said elongated base rail is formed of a second, different material of rigid vinyl or rigid PVC and said first material is coextruded with said second material.

2. The film cutter of claim 1 wherein said upper portion of said blade housing has a grip surface, said grip surface having a concave shape.

3. The apparatus of claim 1 wherein said blade housing is formed of a flexible material providing lubricity.

4. The apparatus of claim 3 wherein said blade housing is formed of acetal or silicon.

5. The film cutter of claim 1 wherein said blade housing is formed of a left section and a right section, said blade is attached to said left section and said right section with a rivet extending through an aperture of said blade.

6. The apparatus of claim 1 wherein said blade is angled at a 30° angle from said bottom edge of said upper portion.

7. The apparatus of claim 1 wherein said lower portion is formed of a tracking device for slidably moving in said channel.

8. The apparatus of claim 7 wherein said tracking device is formed of a tubular base, a middle portion attaches said lower portion to said upper portion and said tubular base sliding in said channel having a corresponding tubular shape.

9. The apparatus of claim 8 wherein said middle portion has predetermined length to provide a predetermined clearance between said blade and said rails.

10. The apparatus of claim 7 further comprising a pair of end caps releasably attached to either end of said elongated rail base for providing a bumper of said tracking device in said channel with said end caps, said end caps releasing upon application of excessive force.

11. The apparatus of claim 10 wherein said end cap includes a pair of male protrusions which engage a pair of respective female receptacles on a side surface of said elongated rail base.

12. The apparatus of claim 1 wherein a rear edge of said elongated rail base includes a depression, said depression being adapted to receive a cover of a carton of said film.

13. A method for cutting a plastic wrap comprising
providing the film cutter of claim 1;
receiving said plastic wrap over said pair of rails
clinging said plastic wrap to said rails,
and cutting said plastic wrap with said blade,
wherein said plastic wrap clings to said rails before, during and after cutting of said plastic wrap.

* * * * *